United States Patent [19]

McGuffey

[11] 4,438,861

[45] Mar. 27, 1984

[54] VENTED INLET FOR TANKS LOADED FROM PRESSURIZED TANKERS

[75] Inventor: James W. McGuffey, Lansing, Mich.

[73] Assignee: Process Equipment Corporation, Belding, Mich.

[21] Appl. No.: 308,988

[22] Filed: Oct. 6, 1981

[51] Int. Cl.[3] ..... B65B 3/04

[52] U.S. Cl. ..... 220/86 R; 137/216; 141/285

[58] Field of Search ..... 141/285-310; 220/86 R; 138/112, 113; 285/DIG. 25, 153, 285/154; 4/209; 137/583, 216

[56] References Cited

U.S. PATENT DOCUMENTS

| | | | |
|---|---|---|---|
| Re. 23,545 | 9/1952 | Bond | 138/113 |
| 3,158,169 | 11/1964 | Smith | 285/154 |
| 3,739,937 | 6/1973 | Stock . | |
| 3,974,863 | 8/1976 | Frahm et al. . | |

FOREIGN PATENT DOCUMENTS

| | | | |
|---|---|---|---|
| 852395 | 10/1939 | France | 141/310 |

*Primary Examiner*—Houston S. Bell, Jr.
*Attorney, Agent, or Firm*—Price, Heneveld, Huizenga & Cooper

[57] ABSTRACT

A vented inlet including a lower pipe to be mounted generally vertically within a tank and an upper pipe supported above and generally axially aligned with the lower pipe to define a vent space therebetween. The internal diameter of the upper pipe is smaller than the internal diameter of the lower pipe, so that liquid flowing downwardly through the upper pipe falls through the vent space, into the lower pipe, and consequently into the tank; however, compressed air flowing through the upper pipe is vented through the vent space to the air surrounding the inlet.

12 Claims, 3 Drawing Figures

VENTED INLET FOR TANKS LOADED FORM PRESSURIZED TANKERS

BACKGROUND OF THE INVENTION

This invention relates to inlets for tanks, and more particularly vented inlets for tanks filled from pressurized tankers.

Tanks are often filled with liquid from truck tankers by pressurizing the head space above the liquid within the tanker with compressed air to force the tanker contents into the receiving tank. This is most typically done when the liquid being transferred is a corrosive chemical which would damage a pump. Although such a procedure eliminates the need for a pump, a possibility does exist that the pressurized air within the tanker will follow the liquid into the receiving tank and destroy the tank due to excessive pressure.

Generally speaking, the tanker is connected to the receiving tank by a hose, and the compressed air pushing down on the liquid contents forces the liquid through the hose and into the receiving tank. The frictional resistance offered by the hose and fittings limits the maximum velocity of the liquid moving through the hose to a reasonable value. The air displaced by the liquid entering the tank escapes through the normal vent provided on the tank.

However, when the last of the liquid passes through the hose, the compressed air within the tanker rushes through the hose at an extremely high velocity because this air does not meet significant frictional resistance within the hose as the liquid does. This air enters the head space in the receiving tank and expands with almost explosive speed and force. The conventional tank vent cannot relieve this excessive pressure within the tank. When the pressure within the receiving tank exceeds that for which the tank is designed, either the tank head blows off or some other portion of the tank ruptures.

Preferably, the person operating the tanker will interrupt the liquid flow before the last of the liquid leaves the tanker, preventing the compressed air from entering the tank. However, through inattention or carelessness, the operator will occasionally forget to interrupt the liquid at the appropriate time.

Typically, the only prior art solution to the problem is to install a plurality of, or larger, conventional vents on the tank to handle this compressed air. However, these vents increase both the complexity and cost of the tank and do not prevent the compressed air from entering the tank.

SUMMARY OF THE INVENTION

The aforementioned problems are solved by the present invention. Essentially, a vented inlet is provided having a lower pipe adapted to be mounted generally vertically within a tank, an upper pipe to receive a filler hose connection and having an internal diameter somewhat smaller than the internal diameter of the lower pipe, and structure for supporting the upper pipe above and generally axially aligned with the lower pipe to define a vent space therebetween.

When fitted with such an inlet, a tank can be safely filled by connecting a filler hose to the upper pipe and forcing liquid through the hose in a conventional manner. Because the upper pipe has an internal diameter somewhat smaller than the internal diameter of the lower pipe, the liquid transferred through the inlet passes through the upper pipe and falls through the vent space into the lower pipe and into the tank. If a sudden rush of compressed air is allowed to follow the liquid through the hose, it is vented to the air surrounding the inlet through the vent space between the two pipes. Accordingly, the receiving tank will never be damaged because the compressed air never enters the tank. No vents, other than a single conventional vent, are required on the tank.

These and other objects, advantages, and features of the invention will be more fully understood and appreciated by reference to the written specification and appended drawings.

DESCRIPTION OF THE PREFERRED EMBODIMENT

Figure 1:
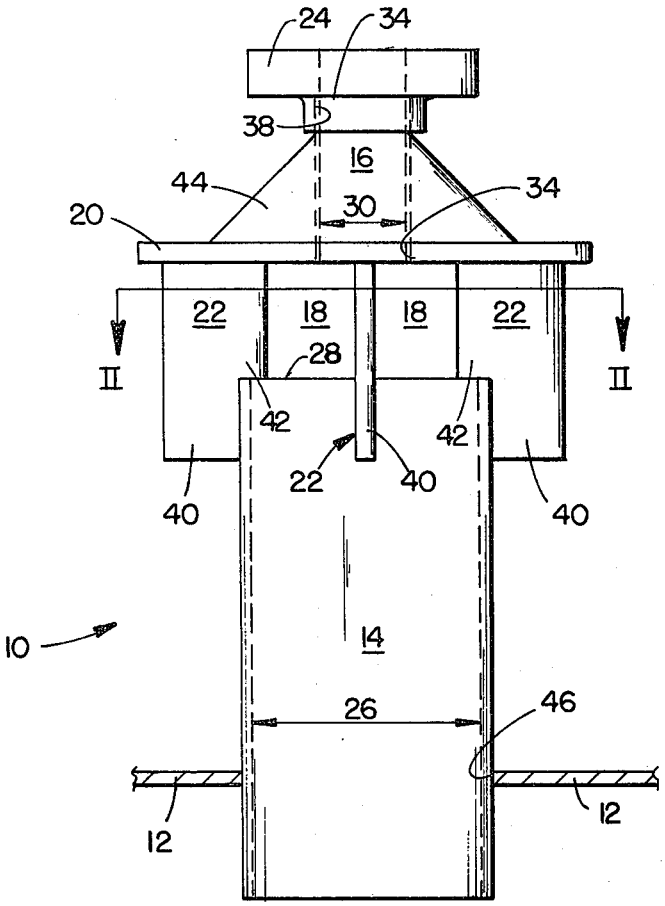
FIG. 1 is an elevational view of a vented inlet in accordance with the present invention.

A vented inlet constructed in accordance with the present invention is illustrated in the drawings and generally designated 10. As seen in FIG. 1, inlet 10 is mounted within a tank 12 through the tank head if the tank is oriented vertically and through a side wall if the tank is oriented horizontally. Generally, inlet 10 comprises lower pipe 14 mounted generally vertically within tank 12 and upper pipe 16 supported above and generally axially aligned with lower pipe 14 to define vent space 18 therebetween. Upper pipe 16 is supported on disc 20, which is in turn supported by gussets 22 and lower pipe 14. A flange 24 is secured to upper pipe 16 to facilitate connection of a filler hose nozzle thereto.

The internal diameter of upper pipe 16 is somewhat smaller than the internal diameter of lower pipe 14. Consequently, liquid flowing through upper pipe 16 will fall through vent space 18, into lower pipe 14, and into tank 12 without spillage. However, if compressed air within the tanker is allowed to flow through upper pipe 16, this air is vented to the surrounding atmosphere through vent space 18 so that this air never enters tank 12. Therefore, inlet 10 allows for readily safely introducing liquid into a tank from a pressurized tanker.

Turning more specifically to the construction of inlet 10, it is seen that lower pipe 14 is a generally cylindrical member having a uniform internal diameter 26 along its entire length. The lower end of pipe 14 is mounted within and extends upwardly from tank 12, terminating in upper end 28.

Upper pipe 16 is also a generally cylindrical member having a generally uniform internal diameter 30 along its entire length. Lower end 32 of pipe 16 is secured within aperture 34 in disc 20, and upper end 34 of pipe 16 is secured within flange 24.

Upper pipe is generally axially aligned with lower pipe 14 so that lower end 32 of upper pipe 16 is generally concentric with upper end 28 of lower pipe 14. It is important that internal diameter 30 of upper pipe 16 be at least somewhat smaller than internal diameter 26 of lower pipe 14 to insure that liquid flowing downwardly through pipe 16 will fall into lower pipe 14 without spillage. In the preferred emodiment, internal diameter 30 of upper pipe 16 is approximately one-half the size of internal diameter 26 of lower pipe 14.

Flange 24 is mounted on upper pipe 16 to facilitate the connection of a filler hose connection, or nozzle, (not shown) to inlet 10. Flange 24 defines aperture 38 in which upper end 34 of pipe 16 is secured. Aperture 38 in flange 24 communicates with pipe 16 so that fluid may flow therethrough.

Figure 2:
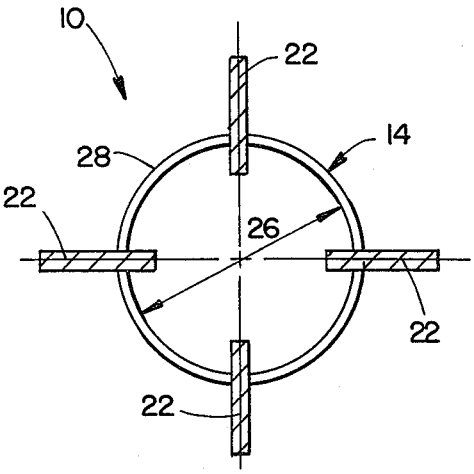
FIG. 2 is a sectional view taken along plane II—II in FIG. 1.
Figure 3:
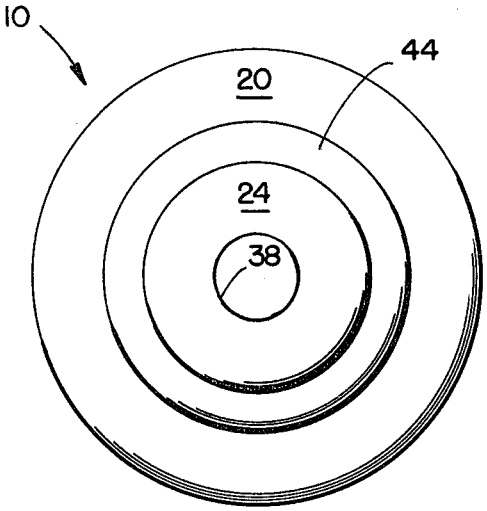
FIG. 3 is a tip plan view of the vented inlet.

Upper pipe 16 is mounted at lower end 32 within aperture 34 in disc 20, which is generally circular planar member. Disc 20 is mounted on and supported by gussets 22, which in turn extend generally longitudinally from upper end 28 of lower pipe 14. In the preferred embodiment, four such gussets 22 are included and oriented generally radially at 90° angles about the circumference of lower pipe 14 (FIG. 2). Gussets 22 are generally planar and L-shaped. One leg 40 of each gusset 22 extends downwardly beyond and outside of upper end 28 while a second leg 42 rests on upper end 28.

With upper pipe 16 so supported above lower pipe 14, vent space 18 is defined therebetween with the vent space occupying a major portion of the space between the upper and lower pipes.In a preferred embodiment, the distance between upper end 28 and lower end 32 is larger than internal diameter 30 of upper pipe 16. Compressed air flowing through upper pipe 16 is vented through vent space 18 beyond gussets 22 to the surrounding air.

Finally, a conical gusset 44 is mounted on disc 20 concentric with aperture 34 to support upper pipe 16. In the preferred embodiment, conical gusset 44 extends the full distance along pipe 16 between disc 20 and flange 24.

OPERATION

To install inlet 10 within tank 12, a circular aperture 46 is formed in the tank, and lower pipe 14 is mounted within aperture 46. Lower pipe 14, and consequently upper pipe 16, should be mounted generally vertically within tank 12 so that liquid flowing through upper pipe 16 will drop directly into lower pipe 14 and into tank 12. Additionally, a conventional vent (not shown) may be installed at a separate location on tank 12.

When a liquid is to be introduced under pressure from a tanker into tank 12, a filler hose connection, or nozzle, is connected to flange 24. The tanker is then pressurized so that liquid flows through the filler hose and upper pipe 16. This liquid then flows out of lower end 32 of pipe 16, through vent space 18, and into lower pipe 14. As tank 12 is filled, the air within tank 12, displaced by the liquid, is vented out of tank 12 through the conventional vent.

If compressed air is allowed to pass through the filler hose, this air escapes through vent space 18 past gussets 22 to the surrounding air. Consequently, compressed air is vented by the inlet so that the air never enters tank 12, eliminating any chance of over pressurizing the tank.

When filling is complete, the filler hose is removed from flange 24. Optionally, inlet 10 may then be covered with a water-proof shroud (not shown) to prevent foreign material and debris from entering the tank.

It should be understood that the above description is intended to be that of a preferred embodiment of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A vented inlet for a tank loaded from a pressurized tanker, said inlet reducing the possibility of damage to the tank from a surge of compressed air by venting the compressed air to the surrounding air before the compressed air enters the tank, said inlet comprising:

a lower pipe to be mounted generally vertically within the tank, said lower pipe having an upper end;

an upper pipe having an upper end to receive a filler hose nozzle and a lower end; and means supporting said upper pipe above and generally axially aligned with said lower pipe thereby defining a vent space between said lower and upper pipes, said supporting means including a plurality of generally planar support members each positioned between said upper and lower pipes, said support members being oriented generally radially with respect to said first and second pipes, said vent space occupying a major portion of the space between said upper and lower pipes, whereby liquid flowing out of said lower end of said upper pipe falls through said vent space and into lower pipe and any compressed air flowing out of said lower end of said upper pipe will pass through said vent space and between said support members to the surrounding air.

2. An inlet as defined in claim 1 further comprising a circular flange mounted on said upper end of said upper pipe to facilitate reception of said filler hose nozzle.

3. An inlet as defined in claim 1 wherein said supporting means further comprises a disc member defining an aperture in which said lower end of said second pipe is mounted; and wherein said support members extend between said upper end of said lower pipe and said disc member to support said disc member above said lower pipe.

4. An inlet as defined in claim 3 further comprising a conical gusset mounted on said disc member concentric with said upper pipe to support said upper pipe.

5. An inlet as defined in claim 1 wherein the distance between said upper end of said lower pipe and said lower end of said upper pipe is at least as large as the internal diameter of said upper pipe.

6. An inlet as defined in claim 1 wherein the internal diameter of said upper pipe is smaller than the internal diameter of said lower pipe.

7. A vented inlet for a tank loaded from a pressurized tanker, said inlet reducing the possibility of damage to the tank from a surge of compressed air by venting the compressed air to the surrounding air before the compressed air enters the tank, said inlet comprising:

a lower pipe having an upper end;

a plurality of generally planar gusset members extending longitudinally from said upper end of said lower pipe, each of said gusset members being oriented generally radially with respect to said lower pipe, each of said gusset members having a first portion mounted on said lower pipe and a second portion remote from said lower pipe; and an upper pipe having a lower end operatively supported on said second portions of said gusset members and an upper end to receive a filler hose connection, said upper pipe being generally axially aligned with said first pipe, whereby liquid flowing out of said lower end of said upper pipe falls through said vent space and into said lower pipe and any compressed air flowing out of said lower end of said upper pipe will pass through said vent space and between said support members to the surrounding air.

8. An inlet as defined in claim 7 further comprising a circular flange mounted on said upper end of said upper pipe to facilitate reception of said filler hose nozzle.

9. An inlet as defined in claim 7 further comprising a disc member mounted on said second portions of said gusset members and defining an aperture generally axially aligned with said lower pipe and wherein said lower end of said upper pipe is mounted within said aperture in said disc member.

10. An inlet as defined in claim 9 further comprising a conical gusset mounted on said disc member concentric with said upper pipe to support said upper pipe.

11. An inlet as defined in claim 7 wherein the distance between said upper end of said lower pipe and said lower end of said upper pipe is at least as large as said internal diameter of said upper pipe.

12. An inlet as defined in claim 7 wherein the internal diameter of said upper pipe is smaller than the internal diameter of said lower pipe.

* * * * *